US005680705A

United States Patent [19]

Josoha

[11] Patent Number: 5,680,705

[45] Date of Patent: Oct. 28, 1997

[54] MULTI-BLADE KNIFE

[76] Inventor: Mesinger Josoha, 34 Abba Uhshi Street,, Haifa, Israel

[21] Appl. No.: 432,699

[22] Filed: May 2, 1995

[30] Foreign Application Priority Data

May 4, 1994 [IL] Israel ..... 109554

[51] Int. Cl.[6] ..... B26B 1/00; B26B 1/10

[52] U.S. Cl. ..... 30/304; 30/320

[58] Field of Search ..... 30/304, 305, 320, 30/114

[56] References Cited

U.S. PATENT DOCUMENTS

| | | | |
|---|---|---|---|
| 2,448,383 | 8/1948 | Mathaus | 30/304 |
| 3,045,348 | 7/1962 | Dungan | 30/304 |
| 3,452,754 | 7/1969 | Stayer | 30/304 X |
| 4,472,879 | 9/1984 | Sizemore | 30/304 |

FOREIGN PATENT DOCUMENTS

| | | | |
|---|---|---|---|
| 2322076 | 12/1973 | Germany | 30/114 |

*Primary Examiner*—Douglas D. Watts

*Attorney, Agent, or Firm*—Lowe, Price, LeBlanc & Becker

[57] ABSTRACT

A multi-bladed knife is formed with three parallel blades attached to a handle by means of a screw rod and spring arrangement mounted at front and rear portions of the handle, respectively. The screw rod fastens the blades to the front end of the handle and is rotatable to adjust the transverse spacing between the blades. Application of manual gripping pressure to the rearward portion of the handle against spring bias serves to direct the outer blades into a diverging angle relative to the handle so as to facilitate release of the knife from an object being cut. Release of manual pressure restores the outer blades to their parallel state.

7 Claims, 5 Drawing Sheets

MULTI-BLADE KNIFE

The present invention relates to a multi-blade knife, More specifically, the invention relates to a knife with several parallel blades joined together to one handle, particularly useful for cutting slices of food products such as vegetables for salad, cheeses and hard boiled eggs.

To date a regular knife with one blade and handle is generally used to cut food products in the kitchen such as tomatoes and cucumbers for salads. It is necessary therefore while cutting the produce to repeat the operation again and again for every slice. The multiple-blade knife according to the present invention has more than one blade attached to the handle. The blades are parallel and enable to economize on the number of cuts because every for cutting operation produces several slices according to the number of blades.

The present invention relates to a multiple blade knife to be used especially to cut food produce in slices, composed of a handle and blades wherein the knife is characterized by parallel blades joined to the handle, and wherein the handle has the means for pre-setting and changing the desired parallel distance between blades and the means for temporary removal of parallel blades in order to release the knife from the products after the cutting is completed.

The means for pre-setting of the distance and/or for temporary removal of parallel blades are optional and the invention relates also to knives with parallel blades at given distances without the means to set and change the distance between blades and/or without means for temporary removal of parallel blades.

The preferred knife has three parallel blades attached to the handle. The distances between blades can range from several millimeters one from the other up to several centimeters one from the other.

A rod with an aproperiate screwing direction positioned along the width of the handle perpendicular to the blades and through them, located at the point where the blades join the handle can be used as the means for setting distances between blades. The distance between blades will be determined according, to the extent to which the rod is rotated like a screw. This is only an example, and the invention relates to any mechanical means by which the distance between blades can be changed.

A temporary distancing of the blades one form the other at a certain opening angle is preferable at times to release the knife from the food product when the cutting is finished. As an example it is possible to use a set of springs inside the handle and/or flexible material such as rubber inside the handle, or a handle made entirely of rubber, giving a certain flexibility and spring to the handle enabling it, when pushed inward, to slightly push the blades passing through it one towards the other and at the same time to move and slightly distance the outer blades away from each other at a certain angle.

It is also possible to ease the release of the knife from the produce by bouncing one or more blades upwards by pushing a button on the handle and with the help of a spring and/or any other appropriate pulley.

The present invention will be further exemplified and described in detail by FIGS. 1–4. The drawings are not intended to limit the scope of the invention but only to clarify and exemplify it.

DETAILED DESCRIPTION OF THE DRAWINGS

Figure 1:
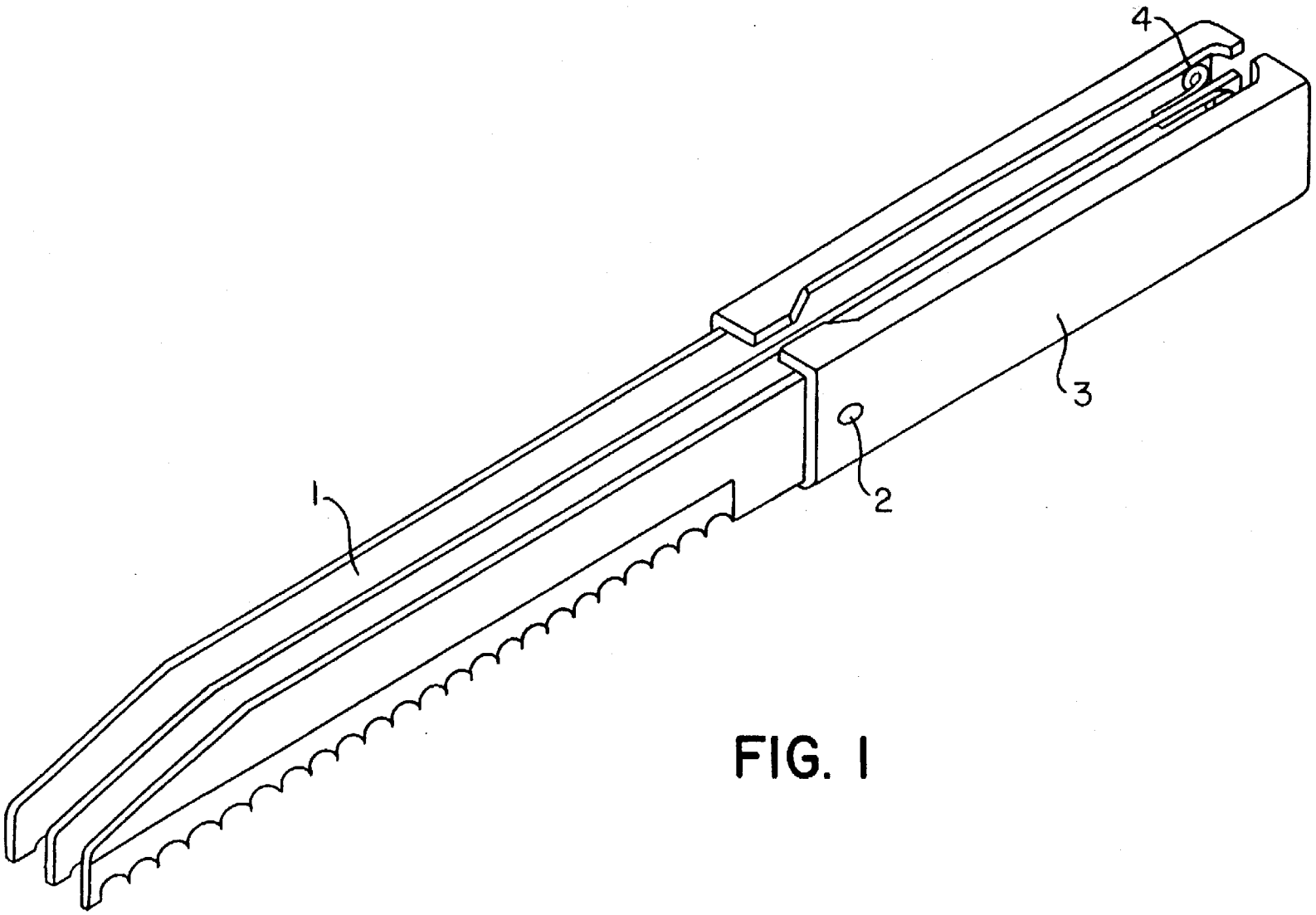
FIG. 1 illustrates the knife isometrically according to the invention (with 3 parallel blades).

FIG. 1 illustrates isometrically a knife with three parallel blades (1), attached to a handle (3) and passing along its length. A screwing rod (2) passing perpendicularly to the blades aids in fastening them to the handle, and in setting their distance from one another. A set of springs (4) enables the rotation of the outer blades in an outward angle contrary to the inward pushing of the handle.

Figure 2:
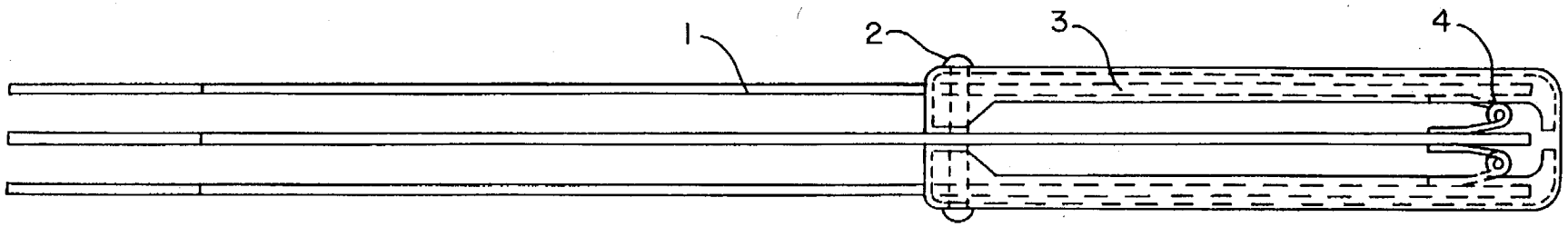
FIG. 2 illustrates the knife according to the invention from a view from above.

FIG. 2 illustrates the same knife described above from a view from above. The blades (1) are fixed to the handle (2) with a screwing rod (2) and pass through the handle (3). A set of springs (4) inside the handle enables the handle to have a certain amount of flexibility—i.e., enables the pushing of the handle inward and then after it has been loosened to return the handle to its original state.

The screwing rod (2) which passes through the handle's width and is perpendicular to the blades can have one half with screwing towards the right and one half with screwing towards the left such that the outer blades will be distanced simultaneously at the rotation of the rod in one direction and will be brought closer when the rod is rotated to the other direction.

Figure 3:
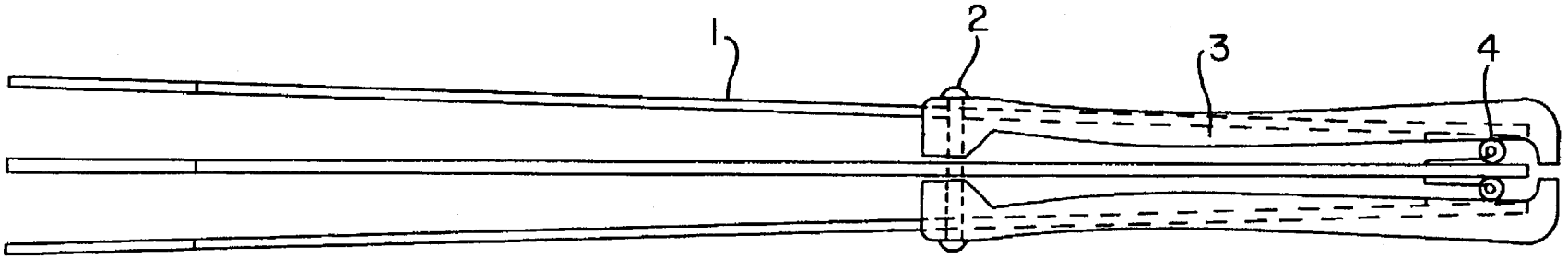
FIG. 3 illustrates the knife according to the invention from a view from above when the handle is pushed inward.

FIG. 3 illustrates the knife from a view from above according to the invention. This differs from FIG. 2 in that FIG. 3 illustrates a state wherein the user pushes the handle (3) inward, and the handle is made flexible by the set of springs inside it (and/or by the flexible material from which it is made). The user's hand pushes the blades positioned inside the handle (1*a*) inward such that the outer blades (1*b*) turn slightly in an outward angle. This deflection helps in releasing the knife from the produce being sliced. Releasing the pressure from the handle restores the knife to its state as described in FIG. 2.

Figure 4:
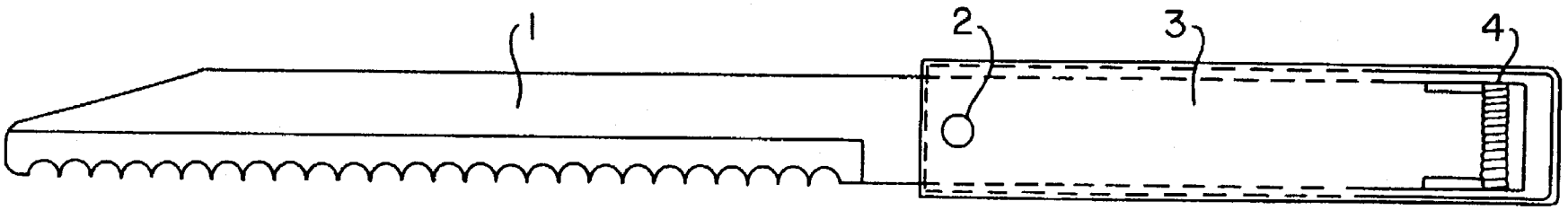
FIG. 4 illustrates the knife according to the invention from a side view.

FIG. 4 illustrates the knife from a side view. The blade (1) is attached within the handle (3), a directional screw (2) sets the distance between the blades and a set of springs (4) contribute flexibility to the handle to enable it to distance the blades from one another when the knife is removed from the sliced product.

Figure 5B:
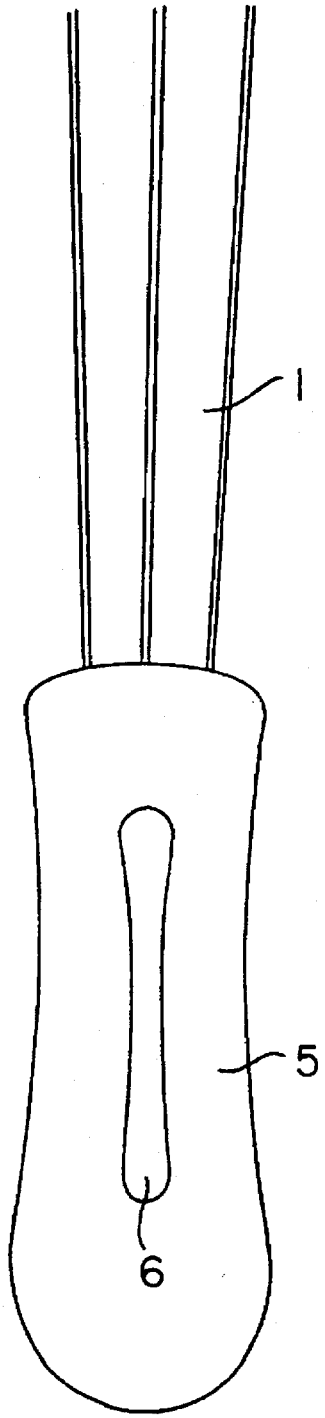
FIGS. 5*a* and 5*b* depict another embodiment of the invention.
Figure 5A:
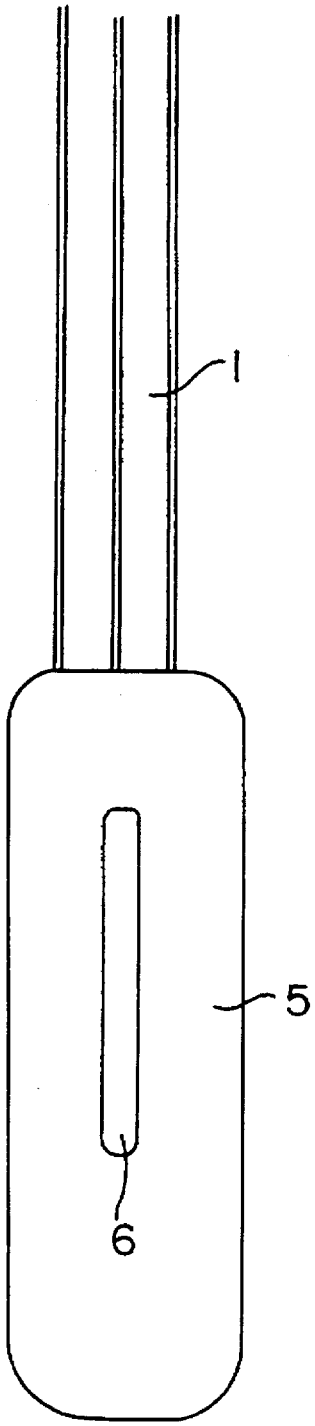

FIGS. 5*a* and 5*b* illustrate from a view from above another preferred embodiment of the invention, wherein the handle (5) is made of a resistent rubber resistent to conditions of heat, dishwasher, kitchen acids and developing acids (e.g. food acids). The blade (1) (e.g. three parallel blades) are inserted and glued to the handle with a glue (e.g. an epoxy glue).

FIG. 5*a* describes the knife wherein the blades (1) are parallel and FIG. 5*b* describes the knife wherein you press on the rubber handle towards the middle and a certain angle is created between the blades which allows the easy release of the produce it is cutting. Along the handle it is best to leave a groove (6) which makes it easier to bend the knife.

I claim:

1. A multiple-blade knife for use in slicing food produce, comprising a handle and at least three generally parallel blades extending from the handle, and wherein the handle includes means for pre-setting a desired parallel spacing between said blades, and means for temporarily changing the spacing of the parallel blades from one another to enable release of the knife blades from the produce being cut, wherein the means for pre-setting said spacing between the blades is a screw rod extending through the handle in threaded contact with at least two blades, rotation of said screw rod thereby changing the spacing.

2. A multiple-blade knife for use in slicing food produce, comprising a handle and blades extending from the handle, and wherein the handle includes means for pre-setting a desired parallel spacing between said blades, and means for temporarily changing the spacing of the parallel blades from one another to enable release of the knife blades from the produce being cut, wherein the means for pre-setting said spacing between the blades is a screw rod extending through the handle in threaded contact with at least two blades, rotation of said screw rod thereby changing the spacing, wherein the means for temporarily changing the spacing of the blades includes said handle including a plurality of handle portions interconnected together at forward ends thereof with the screw rod which defines a pivot axis extending perpendicular to the handle, and resilient means disposed between the handle portions rearwardly of the pivot axis for enabling said handle portions to be manually squeezed together, thereby causing at least two blades to diverge from each other to facilitate release of the produce, release of squeezing pressure enabling said resilient means to restore the handle portions to an unsqueezed position.

3. A multiple-blade according to claim 2 wherein said resilient means is rubber.

4. A multiple-blade knife for use in slicing food produce, comprising a handle and at least three generally parallel blades extending from the handle, said handle including a plurality of handle portions interconnected together at forward end portions thereof, and means disposed between the handle portions rearwardly of the forward end portions for enabling said handle portions to be manually squeezed together, thereby causing at least two blades to diverge from each other to facilitate release of the produce, release of squeezing pressure enabling said means to restore the handle portions to an unsqueezed position.

5. A knife according to claim 2, wherein at least three parallel blades extend from the handle.

6. A multiple-blade knife for use in slicing food produce, comprising a handle and blades extending from the handle, and wherein the handle includes means for pre-setting a desired parallel spacing between said blades, and means for temporarily changing the spacing of the parallel blades from one another to enable release of the knife blades from the produce being cut, wherein the means for temporarily changing the spacing between the parallel blades includes a handle made of a rubber, wherein pressing on the handle compresses the rubber between portions of the blades disposed within the handle to thereby flex portions of the blades projecting from the handle away from each other.

7. A multi-blade knife according to claim 6 wherein the rubber handle includes at least one groove which makes it easier to squeeze the handle.

* * * * *